US011787620B2

(12) United States Patent
Beurcq et al.

(10) Patent No.: US 11,787,620 B2
(45) Date of Patent: Oct. 17, 2023

(54) VALVE HOLDING DEVICE FOR POCKET REFILL, POCKET REFILL AND REFILLABLE DISPENSER CASING COMPRISING SAME

(71) Applicant: INOSPRAY, Nersac (FR)

(72) Inventors: Jean-Luc Beurcq, Gond Pontouvre (FR); Thibault De Maillard, Angouleme (FR)

(73) Assignee: INOSPRAY, Nersac (FR)

( * ) Notice: Subject to any disclaimer, the term of this patent is extended or adjusted under 35 U.S.C. 154(b) by 25 days.

(21) Appl. No.: 17/602,017

(22) PCT Filed: Apr. 2, 2020

(86) PCT No.: PCT/EP2020/059372
§ 371 (c)(1),
(2) Date: Oct. 7, 2021

(87) PCT Pub. No.: WO2020/207890
PCT Pub. Date: Oct. 15, 2020

(65) Prior Publication Data

US 2022/0153507 A1 May 19, 2022

(30) Foreign Application Priority Data

Apr. 11, 2019 (FR) ..... 1903877

(51) Int. Cl.
*B65D 83/62* (2006.01)
*B65D 83/20* (2006.01)
(Continued)

(52) U.S. Cl.
CPC ..... *B65D 83/62* (2013.01); *B65D 83/207* (2013.01); *B65D 83/32* (2013.01); *B65D 83/42* (2013.01); *B65D 83/70* (2013.01)

(58) Field of Classification Search
CPC ..... B65D 83/62; B65D 83/207; B65D 83/32; B65D 83/42; B65D 83/70; B05B 11/047; B05B 11/026; B05B 11/0044
See application file for complete search history.

(56) References Cited

U.S. PATENT DOCUMENTS 3,372,839 A * 3/1968 Hayes ..... B65D 83/70 222/94
5,630,531 A 5/1997 Gaucher
(Continued)

FOREIGN PATENT DOCUMENTS

EP 0820416 1/1998
EP 0975533 2/2000
(Continued)

OTHER PUBLICATIONS

Internatiol search report dated Jul. 3, 2020, for international application No. PCT/EP2020/059372.

*Primary Examiner* — Bob Zadeh
(74) *Attorney, Agent, or Firm* — Perman & Green, LLP

(57) ABSTRACT

A pouch reservoir for a pressurized dispenser casing, having a pouch and a dome provided, in its lower part, with a tubular base provided with an external profile for receiving and welding a neck of the pouch and, in its upper part, with a housing for receiving a valve for dispensing a product contained in the pouch. The tubular base and the neck of the pouch welded to the external profile are each provided with a degassing hole at the external profile.

17 Claims, 4 Drawing Sheets

(51) Int. Cl.

| | |
|---|---|
| ***B65D 83/32*** | (2006.01) |
| ***B65D 83/42*** | (2006.01) |
| ***B65D 83/70*** | (2006.01) |

(56) References Cited

U.S. PATENT DOCUMENTS

| | | | | |
|---|---|---|---|---|
| 6,959,840 | B2 | 11/2005 | Iwatsubo | |
| 7,661,560 | B2 * | 2/2010 | Murray | B65D 47/147 222/525 |
| 2008/0314475 | A1 * | 12/2008 | Fransen | B65D 83/62 222/402.1 |
| 2012/0241457 | A1 * | 9/2012 | Hallman | B65D 83/38 222/402.1 |
| 2016/0167868 | A1 * | 6/2016 | De Maillard | B65B 3/04 53/410 |
| 2017/0183137 | A1 | 1/2017 | Walton et al. | |
| 2017/0043994 | A1 * | 2/2017 | Kraenzle | B67D 1/0807 |
| 2018/0178940 | A1 * | 6/2018 | Taruno | B65D 85/72 |
| 2022/0153507 | A1 * | 5/2022 | Beurcq | B65D 83/207 |

FOREIGN PATENT DOCUMENTS

| | | | | |
|---|---|---|---|---|
| FR | 2723356 | | 2/1996 | |
| FR | 2723356 | A1 * | 2/1996 | B05B 11/0016 |
| FR | 2811643 | | 1/2002 | |
| FR | 3008397 | | 7/2011 | |
| FR | 3068018 | B1 * | 8/2019 | B65D 83/38 |
| WO | 9635627 | | 11/1996 | |
| WO | 9843894 | | 10/1998 | |
| WO | 0206136 | | 1/2002 | |

* cited by examiner

[Fig. 1]
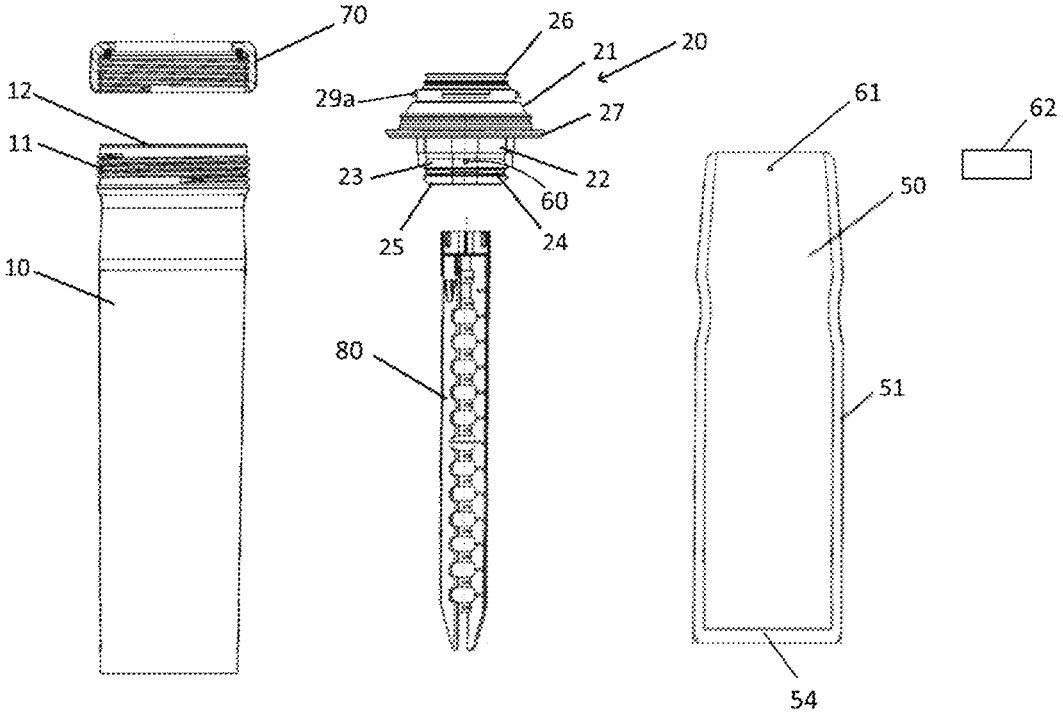

[Fig. 2]
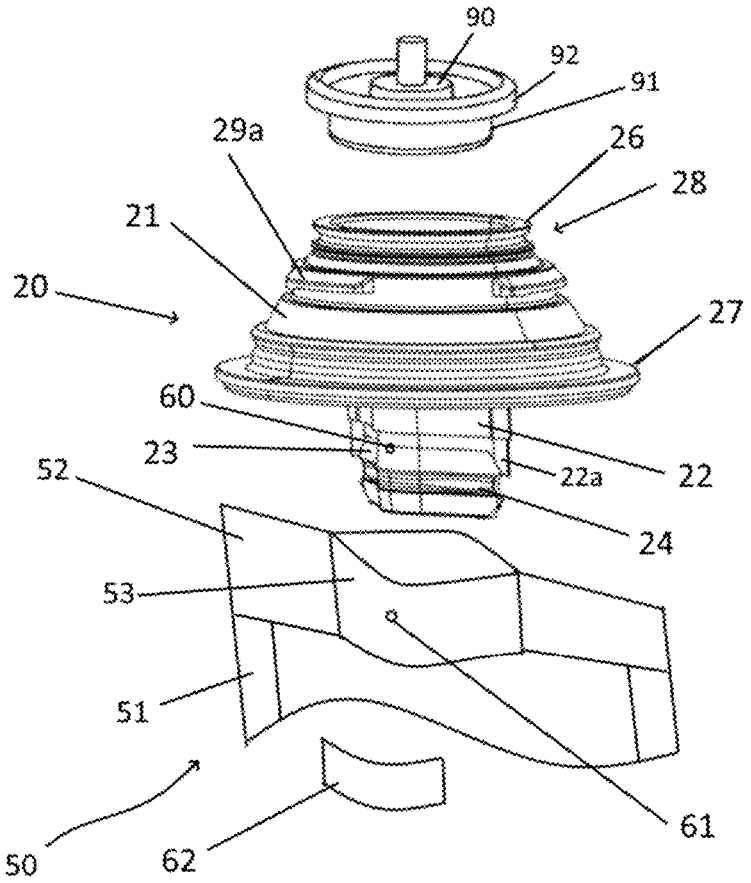

[Fig. 3]
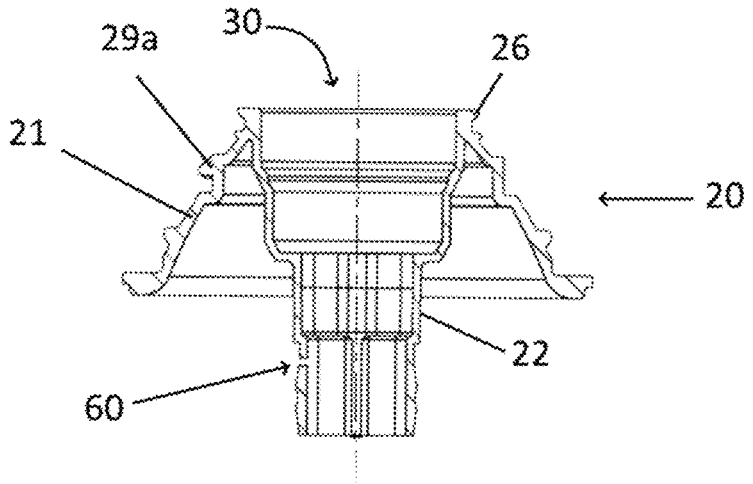
[Fig. 4]
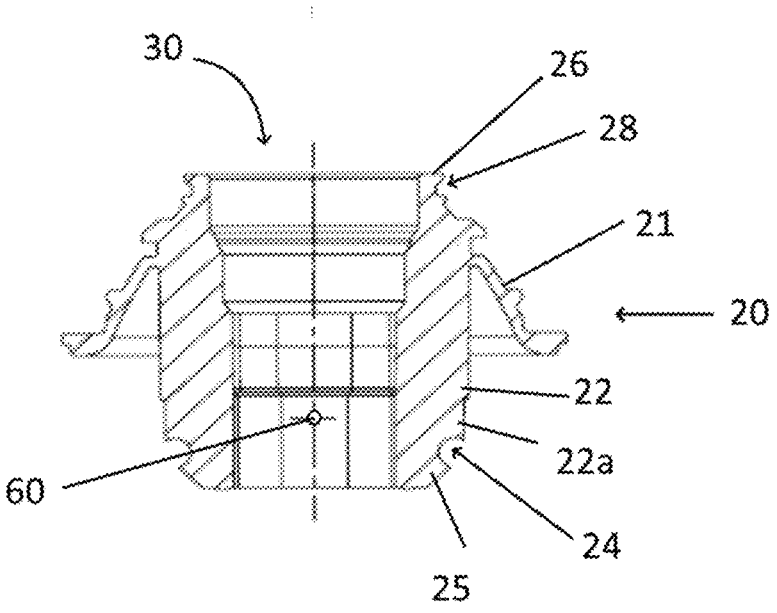

[Fig. 5]
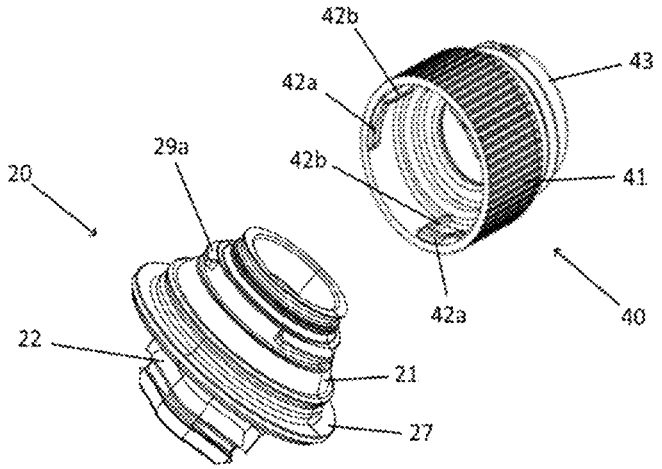
[Fig. 6]
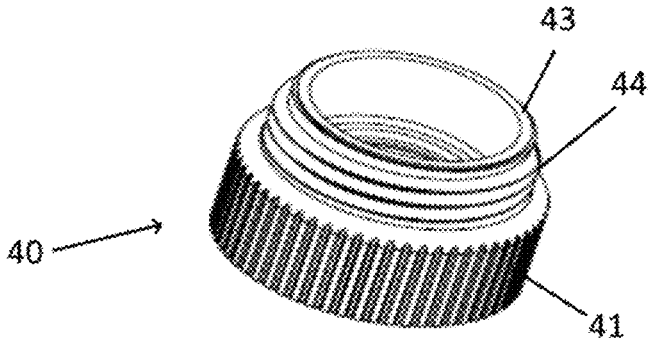

VALVE HOLDING DEVICE FOR POCKET REFILL, POCKET REFILL AND REFILLABLE DISPENSER CASING COMPRISING SAME

CROSS-REFERENCE TO RELATED APPLICATIONS

This application is a National Stage of International Application No. PCT/EP2020/059372, having an International Filing Date of 2 Apr. 2020, which designated the United States of America, and which International Application was published under PCT Article 21(2) as WO Publication No. 2020/207890 A1, which claims priority from and the benefit of French Patent Application No. 1903877, filed on 11 Apr. 2019, the disclosures of which are incorporated herein by reference in their entireties

BACKGROUND

1. Technical Field

The disclosed embodiment relates to pressurized refillable dispenser casings having a pouch reservoir containing a product to be dispensed through a diffusion valve.

2. Brief Description of Related Art

The document FR3008397 A1, in the name of the applicant, describes a pouch reservoir, wherein a valve, secured to a valve holding cup, is mounted on a dome provided with a bowl for receiving the cup, and wherein the bowl acts as an orifice for filling the pouch before the valve holding cup is mounted, the latter being crimped onto a peripheral rim of the bowl.

Such a pouch reservoir is easy to fill, making it possible to make refills more rapidly and at lower cost, said refills taking delicate products that prevent the pouch from being refilled through the valve in the wrong direction.

Furthermore, the document FR 2 723 356 A1 deals with a device having a rigid external container provided with a manual pump mounted on a neck of the external container and in a sealed manner on a neck of a deformable internal container inside the rigid container, that device having air inlet orifices provided so as to form an inlet for outside air into a volume between the rigid external container and the deformable internal container. That document therefore provides for venting of a space between the external container and the internal container while the internal container is sealed.

SUMMARY

The disclosed embodiment aims to improve such a pouch reservoir in order for it to be possible to dispense volatile products such as hydrogen peroxide, for example, which is used as a disinfectant and which, on account of its significant degassing, cannot be easily stored directly in flexible pouches. The disclosed embodiment also aims to improve the welding of a pouch to a closure device such as a valve holding dome and to provide a pouch reservoir that can receive additional equipment for increasing the possible uses of the dispenser casing.

To this end, and according to a first aspect, the disclosed embodiment provides, firstly, a pouch reservoir for a pressurized dispenser casing, having a pouch and a dome provided, in its lower part, with a tubular base provided with an external profile for receiving and welding a neck of the pouch and, in its upper part, with a housing for receiving a valve for dispensing a product contained in the pouch, the tubular base and the neck of the pouch welded to said external profile each being provided with a degassing hole at said external profile for this purpose.

Thus, the pouch can be filled with a product that is liable to degas during storage of the pouch, for example hydrogen peroxide used as a spray for disinfecting premises.

Preferably, the degassing hole of the pouch is covered with a semipermeable membrane, which is adhesively bonded or welded to the pouch and designed to allow a gas to pass through from the inside of the pouch to the outside of the pouch while retaining a liquid contained in the pouch.

This makes it possible to avoid any leaking of a liquid contained in the pouch through the degassing hole.

According to a second aspect of the disclosed embodiment, the dome has a tubular part for welding a pouch, the external profile of which is a profile of elliptical section having narrowed ends forming fins.

The external profile may advantageously have a first annular groove for receiving excess material of the pouch after welding, the first annular groove being surrounded by annular bulges.

The tightness of the welding of the pouch to the dome is thus improved.

According to one particular aspect, the disclosed embodiment provides a dome, the tubular base of which opens out in its upper part into a bowl made in the dome, the bowl forming said housing for receiving a valve that ends in the upper part with an annular flange vertically above a second annular groove for crimping a valve holding cup.

The bowl allows easy filling of the pouch before the valve is crimped onto the dome.

According to a third aspect, the disclosed embodiment relates to a pouch-reservoir and adapter device for mounting an external item of equipment, having a pouch reservoir provided with a dome, wherein the dome has fins for fixing the adapter, which is itself provided with internal fixing ramps complementary to said fins.

This adapter allows the device to become a refill for any applicator system of the gun type for deposition, for example an applicator gun for polyurethane foam, for spraying, or for metering; but also in machines for maintenance: greasing, lubrication, disinfection, etc., or for deposition on manufactured products: glue, ink, etc.

The fins and the ramps advantageously form a fixing device. According to an alternative aspect, the dome has an external thread for fixing the adapter, which is itself provided with a complementary internal thread with or without an end stop.

The adapter may advantageously have a rear gripping part for fixing to the dome and a front part for fixing an accessory provided with a standard external thread.

The disclosed embodiment also provides a refillable dispenser casing having a pouch reservoir according to the disclosed embodiment.

BRIEF DESCRIPTION OF THE DRAWINGS

Further features, details and advantages of the disclosed embodiment will become apparent from reading the detailed description of exemplary aspects of the disclosed embodiment with reference to the appended drawings, in which:

FIG. 1 shows an exploded side view of a refillable casing and a pouch reservoir of the disclosed embodiment;

FIG. 2 shows a perspective three-quarter face-on detail view of the top of a pouch and of a dome according to the disclosed embodiment;

FIG. 3 shows a cross-sectional side view of the dome from FIG. 2;

FIG. 4 shows a cross-sectional rear view of the dome from FIG. 2;

FIG. 5 shows a perspective view of a dome and an adapter according to one aspect of the disclosed embodiment;

FIG. 6 shows a perspective top view of the adapter from FIG. 5.

DETAILED DESCRIPTION

The drawings and the description below relate to exemplary aspects for better understanding the disclosed embodiment, but also for contributing to the definition thereof, where applicable.

FIG. 1 shows a pressurized distributor casing and a pouch reservoir which forms a refill of the distributor casing and comprises various aspects of the disclosed embodiment.

The pouch reservoir has a pouch 50 and a dome 20. The pouch is shown before being mounted on the dome. The pouch, of rectangular overall shape, has two faces, the lower edge 54 and the lateral edges 51 of which are welded, while the upper edge, which is intended to be welded to the dome, allows the pouch to be opened at this stage.

The dome 20 is provided, in its lower part, with a tubular base 22 provided with an external profile 22*a*, 23, 24, 25 for receiving and welding a neck 53 of the pouch.

FIG. 2 shows the shape of the top of the pouch after it has been welded to the dome.

According to a first aspect of the described device, the tubular base and the neck of the pouch welded to said external profile are each provided with a degassing hole 60, 61 at said external profile. The degassing hole has a small diameter of around a millimeter or a few millimeters.

This degassing hole is advantageously made after the pouch has been welded to the dome by drilling with a rotary drill bit or with a heated tip, the figures showing the dome and the pouch in a disassembled state already provided with holes 60, 61 that are only provided by way of illustration, the hole preferably being made after welding to make them easier to produce.

According to FIG. 2, the region of the hole in the pouch is covered, after welding to the dome and drilling, by a section of semi-permeable membrane 62 adhesively bonded or welded to the pouch. This membrane is designed to allow a gas to pass through from the inside of the pouch to the outside of the pouch while retaining a liquid contained in the pouch.

To receive the pouch, the dome is provided in its lower part with a tubular base 22.

This tubular base 22 has an external profile of elliptical section with narrowed ends forming fins 22*a* that act as additional welding surfaces of small cross-sectional area for the pouch in order to limit the risks of a loss of sealing at the weld.

Furthermore, according to an additional or independent aspect shown in particular in FIGS. 2 and 4, the external profile has a first annular groove 24 for receiving excess material of the pouch after welding surrounded by annular bulges 23, 25.

This configuration further improves the welding of the pouch to the dome, reinforces it and avoids any leaking at the weld.

In its upper part, the dome is provided with a housing 30, shown in particular in FIGS. 3 and 4, for receiving a valve 90 for dispensing a product contained in the pouch, the valve being mounted in a traditional manner in a valve holding cup 91, as shown in FIG. 2.

The housing forms a bowl made in the dome, the bowl ending in its upper part with an annular flange 26 for crimping a flange 92 of the valve holding cup, the part of which that is curved during crimping being accommodated in a second annular groove 28.

The dome is a one-piece plastics part that is easy to produce by molding, is inexpensive and robust. Moreover, on account of its being in one piece, the dome is entirely sealed. The upper annular flange 26 and the second annular groove 28 allow sealed and robust crimping of the valve holding cup 91, the refillable casing made of plastics material provided with its refill reservoir then being able to withstand a high internal pressure of greater than 8 bar depending on the manner of fixing the dome to the casing.

According to an additional or independent aspect, the dome has means for fixing an adapter 40 for fixing accessories such as a spray gun. To this end, as shown in FIG. 5, the dome has fins 29*a* for fixing the adapter 40, which is itself provided with internal ramps 42*a*, 42*b* complementary to said fins.

According to this aspect, the fins and the ramps form a quarter-turn fixing device.

In a variant, the dome has an external thread for fixing the adapter, which is itself provided with a complementary internal thread with or without an end stop.

The adapter 40 shown has a knurled or striated rear gripping part 41, the internal part of which serves for fixing to the dome and a front part 43 serves for fixing an accessory provided with an external thread 44 which can be a standard thread for a range of pre-existing accessories.

Returning to FIG. 1, the pouch reservoir has a dip tube 80 which counters collapsing of the pouch when the product is sprayed and an upper part of which is fixed in the tubular base. The pouch reservoir equipped with its valve and filled constitutes a refill and is mounted in a refillable distributor casing 10. The dome has a flange 27 which is positioned on the upper edge 12 of the casing and is pressed in a sealed manner against this upper edge by a clamping ring 70 that is screwed onto a screw pitch 11 of the casing. The flange 27 of the dome may in particular have an elastomer seal attached or molded by two-shot injection molding on its lower surface in contact with the upper edge 12 of the casing.

The pouch reservoir having a pouch 50 and a dome 20 is provided in particular, in its lower part, with a tubular base 22 provided with an external profile 22*a*, 23, 24, 25 for receiving and welding a neck 53 of the pouch and, in its upper part, with a housing 30 for receiving a valve for dispensing a product contained in the pouch, said housing being formed by a bowl made in the dome and surrounded by an annular flange 27 of the dome for fixing the pouch reservoir to one said casing and the tubular base 22 and the neck 53 of the pouch welded to said external profile are each provided with a degassing hole 60, 61 at said external profile under said annular flange 27 of the dome.

This makes it possible in particular to produce a pressurized product dispenser casing having a refillable dispenser casing 10 that receives a pouch reservoir according to the disclosed embodiment or an above-described pouch-reservoir and adapter device in which the flange 27 is positioned on the upper edge 12 of the refillable dispenser 10 and is pressed in a sealed manner against this upper edge by a clamping ring 70 that is screwed onto a screw pitch 11 of the refillable dispenser casing 10, said degassing holes opening into said refillable dispenser casing.

The disclosed embodiment is not limited to the examples shown and in particular the features of the tubular base, the fixing device for the adapter and the degassing system can be used independently of one another.

What is claimed is:

1. A pouch reservoir for a pressurized dispenser casing, having:

a pouch; and a dome provided, in a lower part, with a tubular base provided with an external profile for receiving and welding a neck of the pouch and, in an upper part, with a housing for receiving a valve for dispensing a product contained in the pouch, said dome having a flange between said tubular base and said housing to be positioned on an upper edge of the casing pressed in a sealed manner against the upper edge by a clamping ring to be screwed onto a screw pitch of the casing;

wherein the tubular base and the neck of the pouch welded to said external profile are provided with degassing holes at said external profile of said tubular base under said flange.

2. The pouch reservoir as claimed in claim 1, wherein said external profile is a profile of elliptical section having narrowed ends forming fins.

3. The pouch reservoir as claimed in claim 1, wherein said external profile has a first annular groove for receiving excess material of the pouch after welding, surrounded by annular bulges.

4. The pouch reservoir as claimed in claim 1, wherein the tubular base opens out in the upper part into a bowl made in the dome, the bowl forming said housing for receiving a valve that ends in the upper part with an annular flange vertically above a second annular groove for crimping a valve holding cup.

5. A pouch-reservoir and adapter device for mounting an external item of equipment, having a pouch reservoir as claimed in claim 1, wherein the dome comprises first attachment means for said adapter device, and wherein said adapter device comprises second attachment means complementary to said first attachment means.

6. The pouch-reservoir and adapter device as claimed in claim 5, wherein said first attachment means comprise fins for fixing the adapter device and wherein said second attachment means comprise internal fixing ramps complementary to said fins.

7. The pouch-reservoir and adapter device as claimed in claim 6, wherein the fins and the ramps form a quarter-turn fixing device.

8. A pouch-reservoir and adapter device as claimed in claim 5, wherein said first attachment means comprise an external thread for fixing the adapter device and wherein said second attachment means comprise an internal thread complementary to said external thread.

9. The pouch-reservoir and adapter device as claimed in claim 5, wherein the adapter device has a rear gripping part for fixing to the dome and a front part for fixing an accessory provided with a standard external thread.

10. A refillable dispenser casing having:

a pouch reservoir;

wherein said pouch reservoir comprises a pouch and a dome provided, in a lower part, with a tubular base provided with an external profile for receiving and welding a neck of the pouch and, in an upper part, with a housing for receiving a valve for dispensing a product contained in the pouch, said dome having a flange between said tubular base and said housing to be positioned on an upper edge of the casing pressed in a sealed manner against the upper edge by a clamping ring to be screwed onto a screw pitch of the casing, wherein the tubular base and the neck of the pouch welded to said external profile are provided with degassing holes at said external profile of said tubular has under said flange.

11. The refillable dispenser casing having a pouch reservoir as claimed in claim 10, wherein said external profile is a profile of elliptical section having narrowed ends forming fins.

12. The refillable dispenser casing having a pouch reservoir as claimed in claim 10, wherein said external profile has a first annular groove for receiving excess material of the pouch after welding, surrounded by annular bulges.

13. The refillable dispenser casing having a pouch reservoir as claimed in claim 10, wherein the tubular base opens out in the upper part into a bowl made in the dome, the bowl forming said housing for receiving a valve that ends in the upper part with an annular flange vertically above a second annular groove for crimping a valve holding cup.

14. A refillable dispenser casing having:

a pouch reservoir;

wherein said pouch reservoir comprises a pouch and a dome provided, in its lower part, with a tubular base provided with an external profile for receiving and welding a neck of the pouch and, in its upper part, with a housing for receiving a valve for dispensing a product contained in the pouch, said dome having a flange between said tubular base and said housing positioned on an upper edge of the casing and pressed in a sealed manner against the upper edge by a clamping ring screwed onto a screw pitch of the casing, wherein the tubular base and the neck of the pouch welded to said external profile are provided with degassing holes at said external profile of said tubular base under said flange, said pouch comprising further an adapter device for mounting an external item of equipment, wherein said dome comprises first attachment means for an adapter device, and wherein said adapter device comprises second attachment means complementary to said first attachment means.

15. The refillable dispenser casing having a pouch reservoir as claimed in claim 14 wherein said first attachment means comprise fins for fixing the adapter device and wherein said second attachment means comprise internal fixing ramps complementary to said fins.

16. The refillable dispenser casing having a pouch reservoir as claimed in claim 15, wherein the fins and the ramps form a quarter-turn fixing device.

17. The refillable dispenser casing having a pouch reservoir as claimed in claim 14 wherein said first attachment means comprise an external thread for fixing the adapter device and wherein said second attachment means comprise an internal thread complementary to said external thread.

* * * * *